United States Patent [19]

Wohlfeil

[11] 4,233,930

[45] Nov. 18, 1980

[54] APPARATUS FOR THE CONTINUOUS AND SIMULTANEOUS APPLICATION OF COATINGS OF CONSTANT THICKNESS TO BOTH SIDES OF A WEB

[75] Inventor: Gerhard Wohlfeil, Monheim, Fed. Rep. of Germany

[73] Assignee: Jagenberg-Werke Aktiengesellschaft, Dusseldorf, Fed. Rep. of Germany

[21] Appl. No.: 2,771

[22] Filed: Jan. 9, 1979

[30] Foreign Application Priority Data

Oct. 16, 1978 [DE] Fed. Rep. of Germany ..... 2845036

[51] Int. Cl.[3] ..... B05C 11/04

[52] U.S. Cl. ..... 118/122; 118/413

[58] Field of Search ..... 118/121, 122, 413; 427/209, 211

[56] References Cited

U.S. PATENT DOCUMENTS

| | | | |
|---|---|---|---|
| 3,187,718 | 6/1965 | Coghill | 118/126 |
| 3,489,592 | 1/1970 | Wallsten | 427/209 |
| 3,908,590 | 9/1975 | Quint | 118/122 |

*Primary Examiner*—Evan K. Lawrence

*Attorney, Agent, or Firm*—Sprung, Felfe, Horn, Lynch & Kramer

[57] ABSTRACT

An apparatus for the continuous simultaneous application of coatings of constant thickness to two sides of a material web, having two adjustable two-edged spreader blades confronting one another at an angle, between which the material web passes for the proportioning of the coatings, a chuck for each blade, and means clamping each spreader blade along one edge in the chuck, the other edge of each blade parallel to the clamping line being free and engaging under bias and a corresponding biasing force the material web carried over the free edge of the other spreader blade at an acute angle to the direction of movement of the material web, and means applying a biasing force to each blade along a fulcrum line the improvement wherein one spreader blade is rigid and the other spreader blade is resilient, the chuck of the resilient spreader blade being pivotable about the engagement line between the resilient spreader blade and the rigid spreader blade and about a line outside of the clamping line for movement away from the rigid blade the clamping line of the resilient spreader blade being displaceable relative to the rigid spreader blade to adjust the biasing force while the engagement line and the fulcrum line of the resilient spreader blade are fixed relative to the rigid spreader blade during a continuous coating operation.

11 Claims, No Drawings

APPARATUS FOR THE CONTINUOUS AND SIMULTANEOUS APPLICATION OF COATINGS OF CONSTANT THICKNESS TO BOTH SIDES OF A WEB

BACKGROUND OF THE INVENTION

The invention relates to an apparatus for the continuous, simultaneous application of coatings of constant thickness to both sides of a material web, having two adjustable spreader blades confronting one another at an angle, between which the material web passes for the proportioned feeding of the coatings, at least one spreader blade being clamped on one side in a chuck and engaging under bias and a corresponding biasing force, at its other, free edge parallel to the clamping line, the material web being guided over the free edge of the other spreader blade, doing so at an acute angle to the direction of movement of the material web.

Such an apparatus has been disclosed, for example, by German Pat. No. 1,906,113. In that apparatus the angles of the spreader blades are adjusted with respect to the direction of movement of the material web and the distance between the spreader blades, by means of two clamping devices, for the purpose of obtaining different biases of the blades against one another. A change in the distance between the spreader blades always results in a change of the attitude angle and hence of the configuration of the spreader blades at the spreading area. Furthermore, due to the resilience of the two spreader blades, it is difficult to keep the lines of engagement of the spreader knives at the same level on both sides of the material web.

U.S. Pat. No. 3,187,718 furthermore discloses an apparatus for the constant application of a unilateral coating of constant thickness to a material web, in which a resilient spreader blade clamped on one side in a chuck engages under bias, at its free edge parallel to the clamping line, the material web being carried over a backing roller and carrying coating material applied to it, doing so at an acute angle with respect to the direction of movement of the material web, and is supported in its median portion along a fulcrum line. The chuck at the same time can be pivoted both about the line of engagement of the spreader blade with the backing roller and about a line outside of the clamping line. By the pivoting about the engagement line, the attitude angle of the unstressed spreader blade can be adjusted, and by the pivoting about the line outside of the engagement line, the bias of the spreader knife can be adjusted with a simultaneous alteration of the attitude angle. A change of the bias and hence simultaneously of the attitude angle can be accomplished also by a horizontal, linear displacement of the clamping bar. A fine adjustment of the spreader blade can be accomplished at the support line by varying the pressure in a hose.

In the application of a coating of constant thickness to a material web by means of a resilient spreader blade, the application weight or coating weight, i.e., the thickness of the coating, depends on the one hand on the bias force with which the spreader blade is urged against the backing roller, and on the other hand on the velocity of the material web, the viscosity of the coating material—a paint, for example—and the geometrical shape of the wedge-shaped gap between the spreader blade and the material web, i.e., on the attitude angle of the spreader blade. Of these magnitudes, the bias of the spreader blade as well as the attitude angle of the spreader blade can be varied for the purpose of adjusting the coating thickness. When the bias force and the hydrodynamic pressure are in equilibrium, a specific distance is produced between the free edge of the spreader blade and the support roller, the application weight being determined in this manner.

With the apparatus of U.S. Pat. No. 3,187,718, a variation not only of the attitude angle of the spreader blade but also of the bias of the spreader against the support roller is possible. An adjustment of the bias of the spreader blade at a constant attitude angle, i.e., constant geometrical conditions between the spreader blade and the support roller, however, is neither possible nor intended.

SUMMARY OF THE INVENTION

The object of the invention is to create an apparatus of the kind described above, whereby it will be possible to vary the bias of the spreader blades against the material web for the adjustment or regulation of the coating thicknesses, without altering the geometrical relationships between the spreader blade and the material web, i.e., the attitude angle. Furthermore, the engagement lines of the spreader blades are to be precisely opposite one another on both sides of the material web.

This object is achieved in accordance with the invention in that the one spreader blade is rigid and the other spreader blade is resilient, that the chuck of the resilient spreader blade can be tilted about the engagement line between the resilient spreader blade and the rigid spreader blade and about a line outside of the clamping line, and that the engagement line and the fulcrum line of the resilient spreader blade are in an invariable disposition with respect to the rigid spreader blade, and the clamping line of the resilient spreader blade can be shifted continuously with respect to the rigid spreader blade. Such a design of the coating apparatus is advantageous especially for low application weights, where the force of the hydrodynamic pressure is to be kept as constant as possible.

In the adjustment of the apparatus of the invention, the resilient spreader blade is first tilted into unbiased engagement with the material web or the rigid spreader blade, as the case may be. Then, by tilting the chuck about the spreader blade engagement line, the attitude angle between the resilient spreader blade and the rigid spreader blade is adjusted for optimum conditions of hydrodynamic pressure. The adjustment of the coating thickness or weight and also the control or regulation of the coating thickness is then accomplished during operation by shifting the clamping line of the resilient spreader blade with respect to the rigid spreader blade while preserving unchanged the configuration of the resilient spreader blade between the engagement line and the fulcrum line.

The rigid spreader blade consists advantageously of a resilient part and a rigid support.

It is desirable also that the rigid spreader blade be clamped at one margin in a chuck that can be pivoted about the line of engagement between the rigid spreader blade and the resilient spreader blade, and about a line outside of the clamping line. In this manner the angle of the rigid spreader blade with respect to the material web can be adjusted for optimum hydrodynamic pressure conditions.

It is at the same time also advantageous for the rigid spreader blade to be fulcrumed along a line in its median portion.

The line along which the resilient spreader blade is clamped by its chuck can best be displaceable with linear guidance at an acute angle to the plane defined by the unstressed spreader blade. This will assure, in the adjustment range of the bias, that the resilient spreader blade will not change its configuration between the line of engagement and the fulcrum line at different bias forces, while at the same time the adjustment can be performed in a very sensitive manner.

The linear guidance can best be a sliding guidance of the clamping bar in a slot in the supporting beam. At the same time, spindle feeds and a spindle driving motor are advantageously provided for the displacement of the clamping bar. This provides a sensitively and repeatably adjustable means for the control and regulation of the coating thicknesses.

The fulcruming of the support line in the middle area of the resilient spreader blade is best provided in a rigid and linear manner. This contributes towards maintaining unvaried the configuration of the resilient spreader blade between the engagement line and the fulcrum line and thus the hydrodynamic pressure at various values of the bias of the resilient spreader blade against the rigid spreader blade.

For the support at the fulcrum line it is desirable to provide a rigid fulcrum bar in linear engagement with the resilient spreader blade, and for it to be adjustable by means of positioning screws in the supporting beam along the fulcrum line.

Lastly, it is desirable to bevel the edges of the spreader blades in accordance with the constant attitude angle such that a narrow, blunt edge will remain adjacent the back of the blade. In this manner, the edge of the spreader blade will not have to be worn-in first, but will be relieved by the bevel which will frontally engage the material web or the confronting spreader blade on a relatively broad area. The narrow, blunt edge adjacent the back of the blade has as one of its purposes the prevention of injury to the person installing the spreader blade.

The spreader blades can also engage the material web at different angles, and this may be desirable especially when coating materials of different viscosities are used. Especially when heavy applications are to be made, it can also be desirable to provide for a control and regulation of the attitude angle of the spreader knives instead of a control and regulation of the bias of the spreader knives against one another. This, too, can be accomplished with the apparatus of the invention, setting out from a basic attitude angle and a basic bias of the spreader blades against one another, in which case, however, it is best to use blades which do not have a beveled edge.

BRIEF DESCRIPTION OF THE DRAWING

An embodiment of the invention is represented in the drawings and is further described below. In the drawing.

DESCRIPTION OF THE PREFERRED EMBODIMENTS

Figure 1:
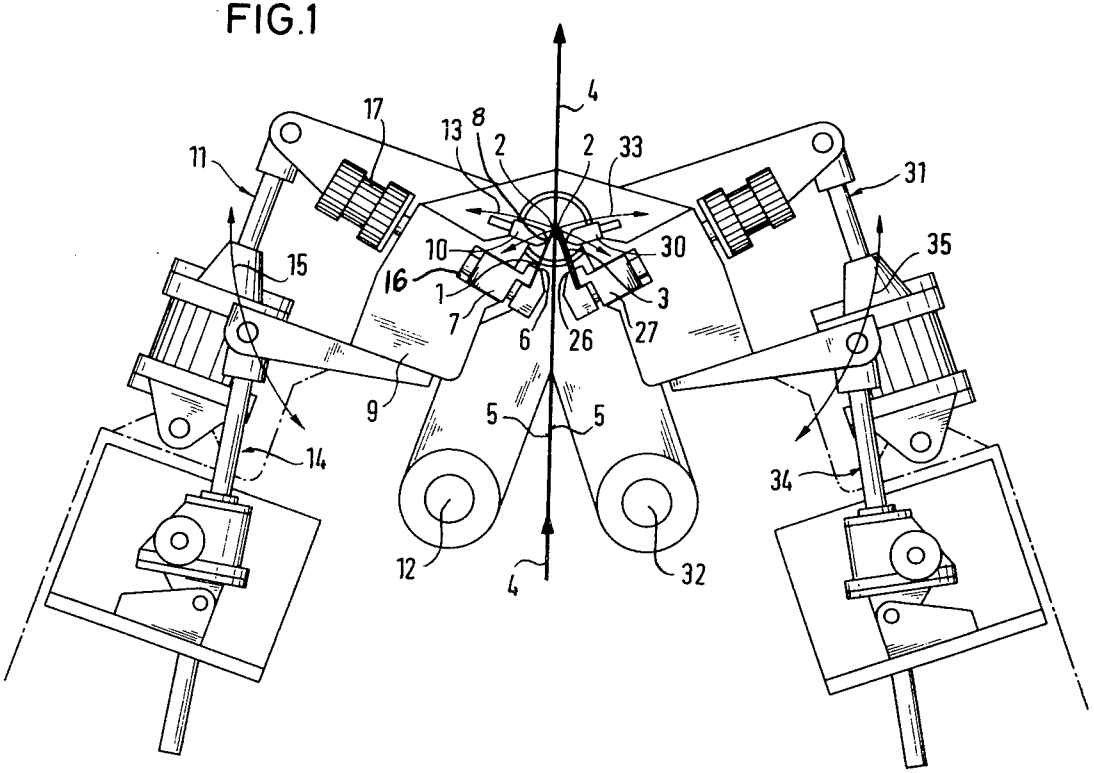
FIG. 1 is a diagrammatic side view of a coating apparatus in accordance with the invention, the feeding mechanism being omitted.

The coating apparatus represented in FIG. 1 has a resilient spreading blade 1 which engages along a line of contact 2 a material web 4 passing over a rigid spreading blade 3 and bearing a coating material applied to it in excess. The spreading blade 1 is gripped along a line 6 in a blade chuck 7 and is fulcrumed along a line 8 on a fulcrum bar 10 seated on a crossbeam 9.

The blade chuck 7 can be pivoted about a shaft 12 by means of an actuator 11 such that the resilient spreading blade 1 can be rocked toward and away from the rigid spreading blade 3, i.e., can be tilted in the directions indicated by the double arrow 13.

Another actuator 14 makes it possible for the clamping bar 7 to be tilted about the line of contact 2 in the directions of the double arrow 15. This tilting serves for the adjustment of the attitude angle of the resilient spreading blade 1 with respect to the rigid spreading blade 3.

The rigid spreading blade 3 is gripped along a line 26 in a blade chuck 27 and is supported along a line 28 by a fulcrum bar 30. The blade chuck 27 can be pivoted about a shaft 32 by means of an actuator 31 similar to actuator 11 such that the rigid spreading blade 3 can be tilted toward or away from the resilient spreading blade 1, i.e., in the directions of the double arrow 33. An additional actuator 34 makes it possible for the blade chuck 27 to be tilted about the line of contact 2 in the directions indicated by the double arrow 35. This movement serves for the adjustment of the attitude angle of the rigid spreading blade 3 with respect to the resilient spreading blade 1.

Figure 2:
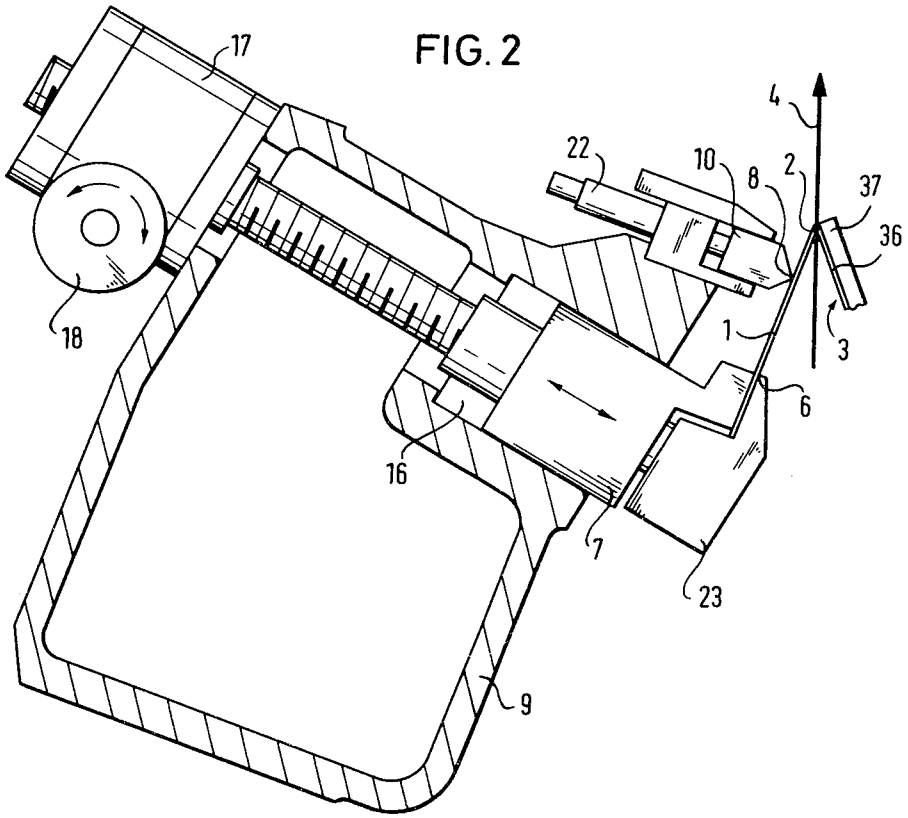
FIG. 2 is a detail of FIG. 1, partially in section, and on an enlarged scale showing resilient spreader blades tilted against the rigid spreading blade, but in the unstressed state.
Figure 3:
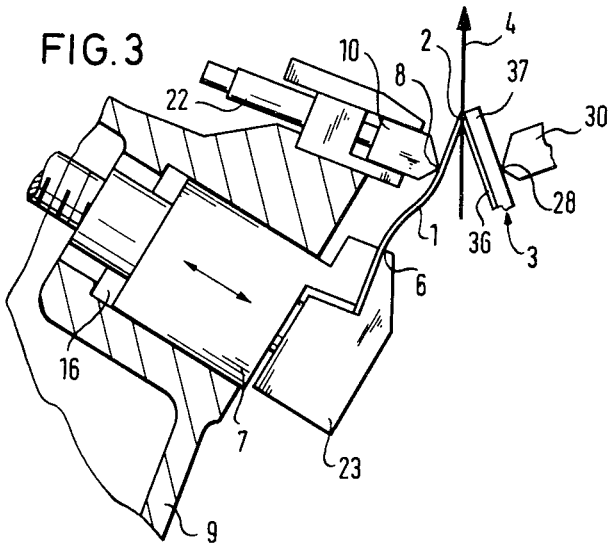
FIG. 3 is a detail corresponding to FIG. 2, showing the resilient spreading blade in the stressed state.

As best seen in FIGS. 2 and 3, the rigid spreading blade 3 consists of a resilient part 36 similar to the resilient spreading blade 1 and a rigid back part 37.

FIG. 1 as well as FIG. 2 shows the resilient spreading blade 1 in the unbiased state engaging the material web 4 or the rigid spreading blade 3, as the case may be. In order to be able to adjust the bias of the resilient spreading blade 1 while its attitude angle with respect to the rigid spreading blade remains unaltered, the blade chuck 7 is slidably held in a groove 16 in the supporting beam 9. Spindle feed mechanisms 17 and a drive motor 18 are provided for the displacement of the chuck 7 in the slot 16. FIG. 3 shows the resilient spreading blade 1 in a position wherein it is biased by the operation of the drive motor 18 without changing the attitude angle or the geometric configuration of the resilient spreading blade 1 between engagement line 2 and fulcrum line 8.

For the adjustment of the above-described coating apparatus, the resilient spreading blade 1 is first brought by means of the actuator 11 into unbiased engagement with the previously adjusted rigid spreader blade 3 along the line of contact 2. Then, by means of the actuator 14, the attitude angle of the resilient spreader blade 1 is adjusted with respect to the rigid spreader blade 3. Lastly, by means of the drive motor 18, the bias of the resilient spreader blade 1 is adjusted in the manner described above. The bias is then controlled at a constant value during operation to keep the weight or the thickness of the coating constant. This method of operation is especially suitable for light applications.

If necessary, the regulation of the thickness of the coating, on the basis of a basic attitude angle and a basic bias of the resilient spreader blade 1, can be accomplished also by varying the attitude angle of the resilient spreader blade 1 during operation by means of the actuator 14, and this may be advantageous in the case of heavy applications.

Figure 4:
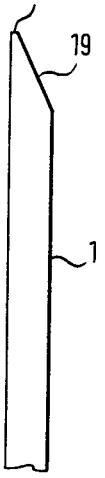
FIG. 4 is a cross-sectional view of the upper edge of a resilient spreading blade with the edge beveled in accordance with the invention.

FIG. 4 shows the upper edge of a resilient spreader blade 1 which has a bevel 19 at an angle corresponding to the attitude angle of the resilient spreader blade 1 with respect to the rigid spreader blade 3. The bevel 19 is made such that a narrow, blunt edge 20 remains on the blade adjacent its back, so as to avoid the danger of personal injury when the blade is installed. The bevel on the resilient spreader blade 1 avoids the need for a wearing-in period when a new blade is installed, and the geometrical relationships of the blade are also entirely constant in the area of the line of contact 2. The resilient part 36 of the rigid spreader blade 3 should have a bevel corresponding to the bevel 19. If, on the other hand, the attitude angle of the resilient spreader blade 1 with respect to the rigid spreader blade 3 should have to be changed during operation, it is desirable then that spreader blades without the bevel 19 be used.

Figure 5:
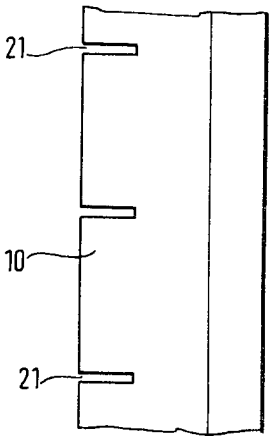
FIG. 5 is a plan view of a portion of a fulcrum bar.

Lastly, FIG. 5 is a plan view of a portion of the fulcrum bar 10 having the slots 21. The fulcrum bar is rigid, and is constructed such that a stiff support is provided along the line 8 in the median portion of the resilient spreader blade 1. The rigid fulcrum bar 10 is adjustable by means of adjusting screws 22 in the supporting beam 9 (see FIGS. 2 and 3). The linear support provided along fulcrum line 8 of the resilient spreader blade, in conjunction with the location of this line 8, contributes substantially to the preservation of the geometric configuration of the resilient spreader blade 1 between fulcrum line 8 and contact line 2, independently of the bias of the resilient spreader blade 1. The resilient spreader blade 1 is held fast to the inner jaw of chuck 7 along the line 6 by means of the outer chuck jaw 23. The rigid fulcrum bar 30 for the rigid spreader blade 3 can be constructed and adjustable similarly to the fulcrum bar 10.

The position of the inner jaw of chuck 7 with respect to the supporting beam 9, and hence the bias of the resilient spreader blade 1, can be indicated digitally at the control board in a simple manner. This permits both an easy and accurate reproducibility and a fully automatic control of regulation of the system by the operation of the drive motor. The required setting can be derived from the metering unit of a coating weight control apparatus.

It will be appreciated that the instant specification and examples are set forth by way of illustration and not limitation, and that various modifications and changes may be made without departing from the spirit and scope of the present invention.

What is claimed:

1. In an apparatus for the continuous simultaneous application of coatings of constant thickness to two sides of a material web, having two adjustable two-edged spreader blades confronting one another at an angle, between which the material web passes for the proportioning of the coatings, a chuck for each blade, and means clamping each spreader blade at a clamping line along one edge in the chuck, the other edge of each blade parallel to the clamping line being free and engaging under bias and a corresponding biasing force the material web carried over the free edge of the other spreader blade along an engagement line at an acute attitude angle with respect to the direction of movement of the material web, and means applying said biasing force to each blade along a fulcrum line, the improvement wherein one spreader blade is rigid and the other spreader blade is resilient, means mounting the chuck of the resilient spreader blade for pivoting movement of the resilient spreader blade about the engagement line between the resilient spreader blade and the rigid spreader blade and about a line outside of the clamping line for movement of said resilient blade away from said rigid blade, and means mounting the clamping means of said resilient blade to effect displacement of the clamping line of the resilient spreader blade relative to its fulcrum line and relative to the rigid spreader blade to adjust the biasing force without changing the attitude angle between the fulcrum line and the engagement line of said resilient blade, while the engagement line and fulcrum line of the resilient spreader blade are fixed relative to the rigid spreader blade during a continuous coating operation.

2. An apparatus according to claim 1, wherein the rigid spreader blade comprises a resilient facing portion and a rigid substrate support therefor.

3. An apparatus according to claim 1, wherein the rigid spreader blade is clamped along one edge in a chuck and further comprising means mounting the chuck for pivoting movement of the rigid spreader blade about the engagement line and about a line outside of the clamping line for movement away from said resilient blade.

4. An apparatus according to claim 3, wherein the means applying the biasing force comprises a rigid fulcrum bar having a line of engagement with each spreader blade at the fulcrum line.

5. An apparatus according to claim 4, further comprising means mounting one of the rigid fulcrum bars for adjustable movement towards and away from the associated spreader blade.

6. An apparatus according to claim 1, wherein the means mounting the clamping means include linear guide means for displacing the clamping line of the resilient spreader blade in its chuck at an acute angle to the plane defined by the unbiased resilient spreader blade.

7. An apparatus according to claim 6, wherein the linear guide means comprises a supporting beam provided with a groove, the chuck sliding in said groove.

8. An apparatus according to claim 6, including a spindle feed mechanism for the displacement of the chuck, and a motor for driving the spindle feed mechanism.

9. An apparatus according to claim 1, wherein each spreader blade is beveled in accordance with the constant attitude angle but has a narrow blunt edge on the top edge adjacent the back face of the spreader blade.

10. An apparatus according to claim 1, wherein the spreader blades engage the material web at different angles.

11. An apparatus according to claim 1, wherein the resilient spreader blade is fulcrumed along a transverse line in the medial portion between the clamping line and the engagement line.

* * * * *